US005513496A

United States Patent [19]

Stokes

[11] Patent Number: 5,513,496

[45] Date of Patent: May 7, 1996

[54] BEVERAGE COOLER AND DISPENSER

[76] Inventor: Patrick F. Stokes, 2280 Stadium Blvd., Twin Falls, Id. 83301

[21] Appl. No.: 372,925

[22] Filed: Jan. 17, 1995

Related U.S. Application Data

[63] Continuation-in-part of Ser. No. 262,979, Jun. 21, 1994, Pat. No. 5,421,159.

[51] Int. Cl.[6] ..... F25B 21/02

[52] U.S. Cl. ..... 62/3.64; 62/389; 62/397; 62/457.4; 222/146.6

[58] Field of Search ..... 62/3.64, 389, 397, 62/3.1, 3.2, 371, 372, 457.1, 457.2, 457.4, 457.9; 222/146.1, 146.6

[56] References Cited

U.S. PATENT DOCUMENTS

| | | | |
|---|---|---|---|
| 296,095 | 4/1884 | Wisloh | 62/397 |
| 1,634,457 | 7/1927 | Doughty . | |
| 2,805,556 | 9/1957 | Wang . | |
| 3,840,153 | 10/1974 | Devlin . | |
| 4,281,520 | 8/1981 | Norwood . | |
| 4,320,626 | 3/1982 | Donnnelly . | |
| 4,413,481 | 11/1983 | Thomas . | |
| 4,640,101 | 2/1987 | Johnson . | |
| 4,681,611 | 7/1987 | Bohner . | |
| 4,884,721 | 12/1989 | Kirchler . | |
| 4,913,713 | 4/1990 | Bender et al. | 62/3.64 |
| 4,932,225 | 6/1990 | Bighouse . | |
| 4,961,324 | 10/1990 | Allan . | |
| 4,996,847 | 3/1991 | Zickler . | |
| 5,042,258 | 8/1991 | Sundhar . | |
| 5,063,754 | 11/1991 | Chou . | |
| 5,115,940 | 5/1992 | Friedman . | |
| 5,341,657 | 8/1994 | Fuller . | |

FOREIGN PATENT DOCUMENTS

| | | |
|---|---|---|
| 3412556A1 | 10/1985 | Germany . |
| 598067 | 3/1948 | United Kingdom . |

*Primary Examiner*—John M. Sollecito
*Attorney, Agent, or Firm*—Richard C. Litman

[57] ABSTRACT

A portable cooler for carrying and chilling a standard beverage container having a threaded cap. The container cap is removed, and the container is threaded into the cooler. The beverage container is inverted when the cooler is upright. The container neck threads into a socket which is in liquid communication with a faucet external to the cooler. A shroud engages the base of the cooler, sealing a chilled chamber defined between the beverage container and the shroud, and retaining the beverage container therein. In an alternative embodiment, the container can be oriented in an upright position, and used in that position. An optional cap cooperates with the shroud or the beverage container. The cap is removable to expose the container, or may be provided with spill and vent holes through which beverage is dispensed. A handle is also optionally provided, so that the cooler can be handled in a manner likened unto a mug or pitcher. A refrigeration plant, which may be a Peltier effect type, is housed inside the base of the cooler. An electrical plug enables connection to a suitable electrical power source. The refrigeration plant provides a chilled air circuit flowing across the beverage container. The cooler is plugged into suitable power, chills the beverage, and dispenses the beverage on demand.

17 Claims, 5 Drawing Sheets

BEVERAGE COOLER AND DISPENSER

This is a continuation-in-part of copending application Ser. No. 08/262,979, filed on Jun. 21, 1994 now U.S. Pat. No. 5,421,159.

BACKGROUND OF THE INVENTION

1. FIELD OF THE INVENTION

The present invention relates to an apparatus for supporting and cooling a beverage container.

2. DESCRIPTION OF THE PRIOR ART

U.S. Pat. No. 5,341,657, issued to James M. Fuller on Aug. 30, 1994, discloses a coolant and beverage container structure. The container structure is configured to complementarily receive and secure a beverage coolant jug in an inverted orientation therewithin.

A container for storing and chilling a beverage is disclosed in U.S. Pat. No. 5,042,258, issued to Shaam P. Sundhar on Aug. 27, 1991. The beverage is held within a removable cup. The cup is in contact with the cooled side of an electrothermal cooler. A power cord enables connection to a supply of electrical power, and a switch is disposed within the power circuit.

A beverage cooler/dispenser is disclosed in U.S. Pat. No. 4,996,847, issued to Melissa Zickler on Mar. 5, 1991. Cooling is provided by a thermoelectric cooling device within the body of the cooler/dispenser in order to cool the beverage container without the inconvenience of replenishing melting ice.

A refrigerated beverage container having an articulated spout is seen in U.S. Pat. No. 4,961,324, issued to Barry S. Allan on Oct. 9, 1990. Chilling is provided by placing a refrigerant in close proximity to a bottle or the like held in the container. The container disclosed herein includes a handle in order to tote the device.

A food receptacle is held in an inverted position in a cooler disclosed in U.S. Pat. No. 4,884,721, issued to Manfred Kirchler on Dec. 5, 1989. The cooler has an internal cavity cooperating in configuration with a can. A Peltier effect cooler is provided to chill the can.

Another Peltier effect cooler is employed in U.S. Pat. No. 4,681,611, issued to Hal J. Bohner on Jul. 21, 1987. A wine bottle is maintained at a predetermined temperature. In alternative embodiments, the heated side of the Peltier device is cooled by an electrically powered fan and by ice.

A portable beverage cooler/dispenser is disclosed in U.S. Pat. No. 4,320,626, issued to Joseph H. Donnelly on Mar. 23, 1982. An automatic cigarette lighter receptacle is provided in order to make use of the cooler in an automobile.

Another portable beverage cooler/dispenser is disclosed in U.S. Pat. No. 1,634,457, issued to William E. Doughty on Jul. 5, 1927. A threaded connection between the beverage container and the beverage container receptacle in order to positively secure the container within the beverage container receptacle.

German Patent Document No. DE 3,412,556, dated October, 1985, discloses a portable cooler having an insulated chamber for holding a beverage container, and a powered refrigeration system. The refrigeration system may be of the compression cycle type, the Peltier effect type, or a liquid absorption type.

None of the above inventions and patents, taken either singly or in combination, is seen to describe the instant invention as claimed.

SUMMARY OF THE INVENTION

The present invention provides an apparatus for chilling the contents of a beverage container, and for dispensing these contents through a faucet formed integrally to the apparatus. A further feature of the apparatus is that the beverage container is opened and fastened to the apparatus, so that the beverage can be dispensed upon demand by operating the faucet. Alternatively, the beverage container is supported by the apparatus so as to be easily and repeatedly removed from, and returned to, the apparatus. An electrically refrigeration plant chills the beverage.

The apparatus comprises a base for supporting a shroud and a beverage container. The shroud envelopes the container insulating the container from the ambient environment.

A refrigeration plant, which may be a miniature compressor, a Peltier effect thermoelectric device, or a miniature liquid absorption chiller, is contained within the body below the beverage container. The refrigeration plant includes, in one embodiment, a fan for circulating chilled air. An electrical cord extends exteriorly of the body.

In one embodiment, the container is secured to the base so as to be in fluid communication with a faucet formed in the base. When the apparatus is held in a normal, upright orientation, the beverage container is inverted. Discharge of the beverage is controlled by the faucet.

In another embodiment, the shroud is integral with the beverage container. The container is supported by the base in a normal upright position. Moreover, the container may be easily and repeatedly removed from, and returned to the base.

In still another embodiment, the shroud has a handle formed in the side, so that it can be lifted and manipulated.

Another optional feature is to provide a cap configured to cooperate with the tapered shroud. This cap can be removed to expose the neck of the beverage container. By removing the cap, liquid can be poured from the beverage container in a manner likened unto a pitcher.

Accordingly, it is a principal object of the invention to provide a portable apparatus for holding and chilling a beverage container.

It is another object of the invention to provide an electrically powered refrigeration plant.

It is a further object of the invention to provide the apparatus with a faucet for dispensing the beverage on demand.

It is yet another object of the invention is to provide a base for supporting a beverage container.

An additional object of the invention is to provide a shroud for enveloping a beverage container, and for improving the insulation value of the container.

Still another object of the invention is that the shroud and beverage container coupled to the base, so that the shroud may be removed from the base independently of the container without disturbing the fluids contained in the container.

Yet another object of the invention is to transfer heat from the beverage container by providing a chilled air circuit within the shroud.

A still further object of the invention is to enable a liquid to be poured from the top of the beverage container, such as in the manner of a mug or pitcher.

Yet an additional object is to provide a handle enabling the novel apparatus to be manipulated.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
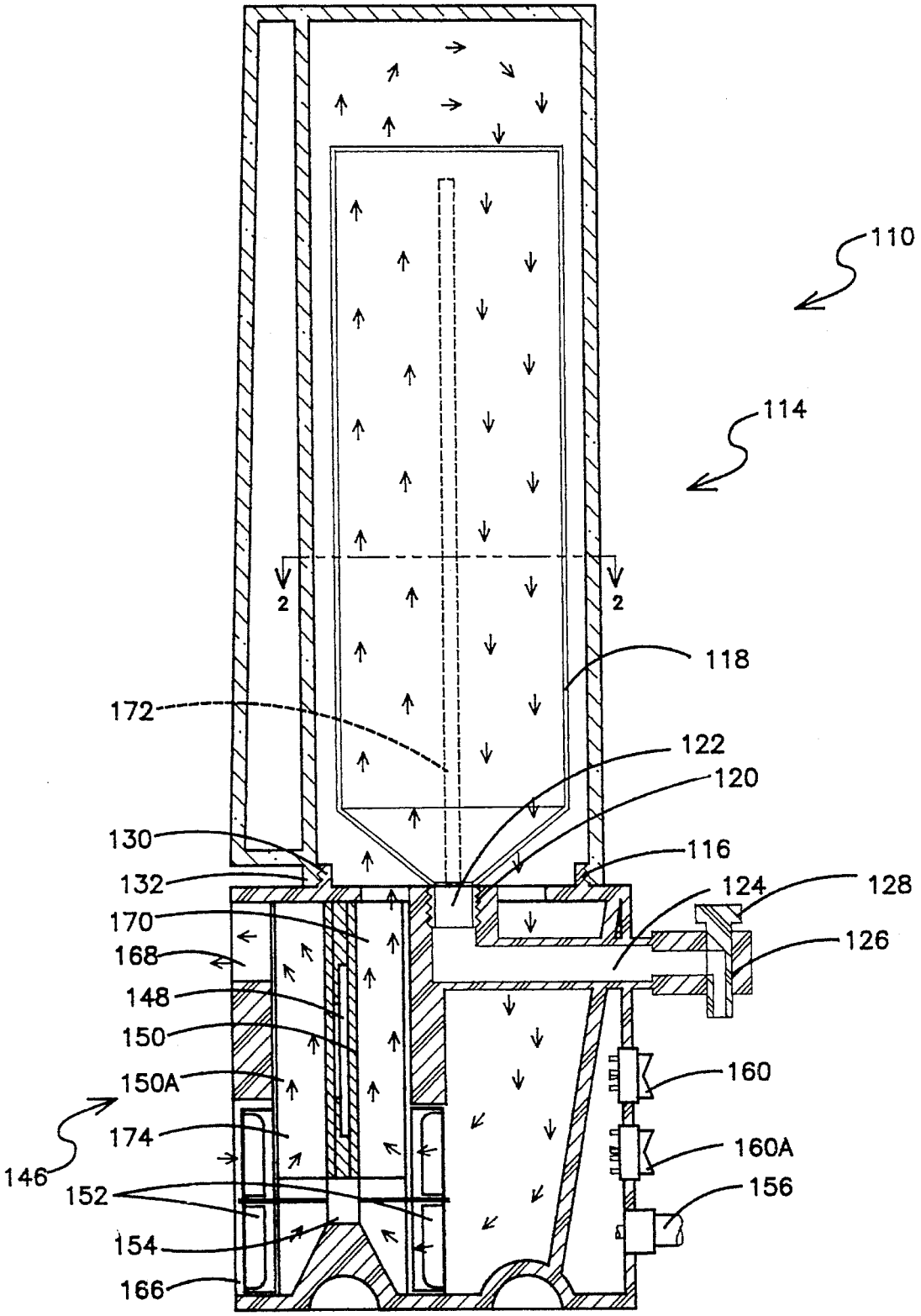
FIG. 1 is a diagrammatic, cross-sectional, side elevational view of the invention, showing a beverage container disposed therein.
Figure 4:
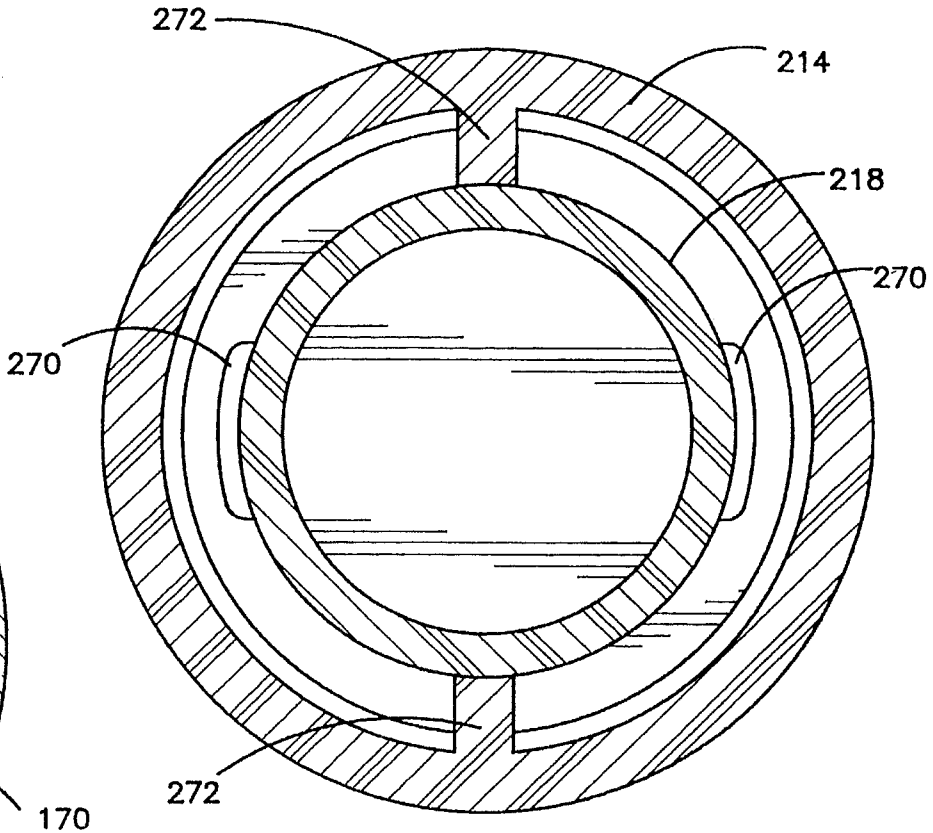
FIG. 4 is a cross-sectional view of the shroud and beverage container taken along the line 4—4 in FIG. 3.
Figure 2:
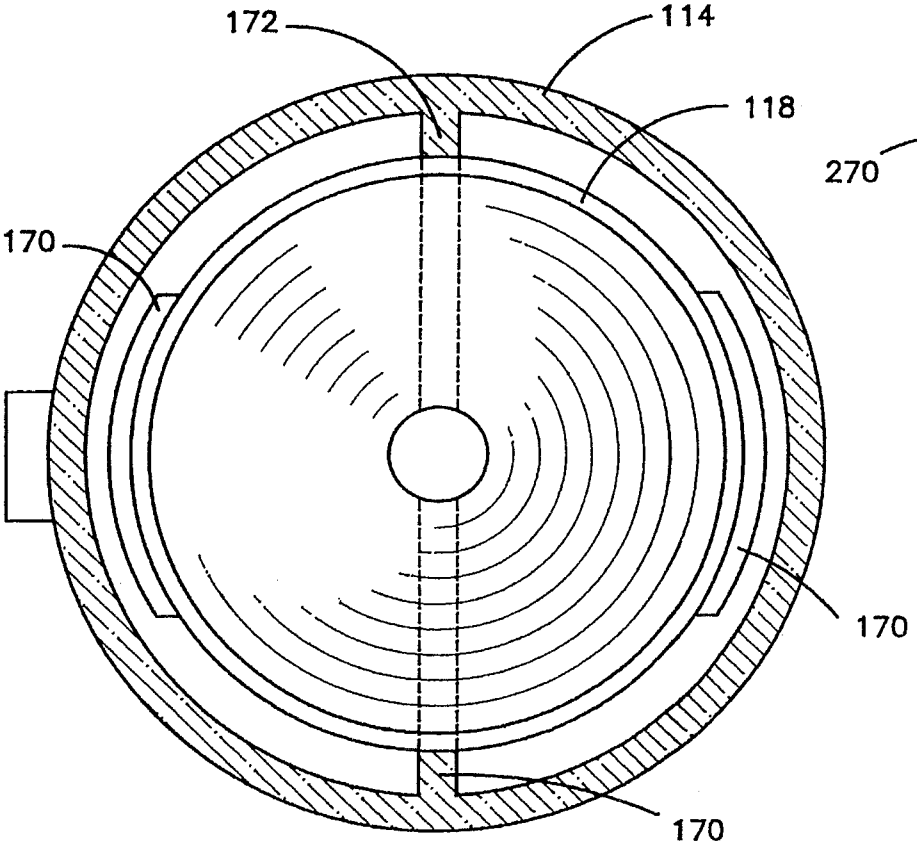
FIG. 2 is a cross-sectional view of the shroud and beverage container taken along the line 2—2 in FIG. 1.

Turning now to FIG. 1 of the drawings, a first embodiment of the novel portable cooler 110 is seen to include a base 112, and a shroud 114 supported by base 112. Shroud 114 extends from a flange 116 located at the top of base 112, in the orientation illustrated. A beverage container 118, of the type having a threaded neck 120, is seen as it will be carried in portable cooler 110. After removal of the threaded cap from beverage container 118 (not shown), beverage container 120 is received in socket 122, and then oriented in an inverted position. Subsequently, beverage container 118 is enveloped by shroud 114. Socket 122 is sufficiently tightly fit to beverage container 118 so that no fluid contained therein escapes. Determining appropriate dimensions and configuration of socket 116 will be facilitated since commercial beverage containers have standardized neck threads and caps.

Socket 122 is in fluid communication with a conduit 124 extending from socket 122 to the exterior of base 112. A faucet 126 is arranged in series within conduit 124 to control dispensation of the beverage. Faucet 126 includes an operating handle 128 accessible to a user from the exterior of base 112.

Beverage container 118 is fully closed by shroud 114. Full closure of beverage container 118 signifies that beverage container 118 is sealed, so that the interior thereof, and hence beverage contained therein, is prevented from fluid communication with the exterior of shroud 114. This improves the insulating ability of shroud 114.

A suitable attachment arrangement includes threads 130 in flange 116 formed in the upper portion of base 112, and cooperating threads 132 formed in the lower portion of shroud 114.

Figure 3:
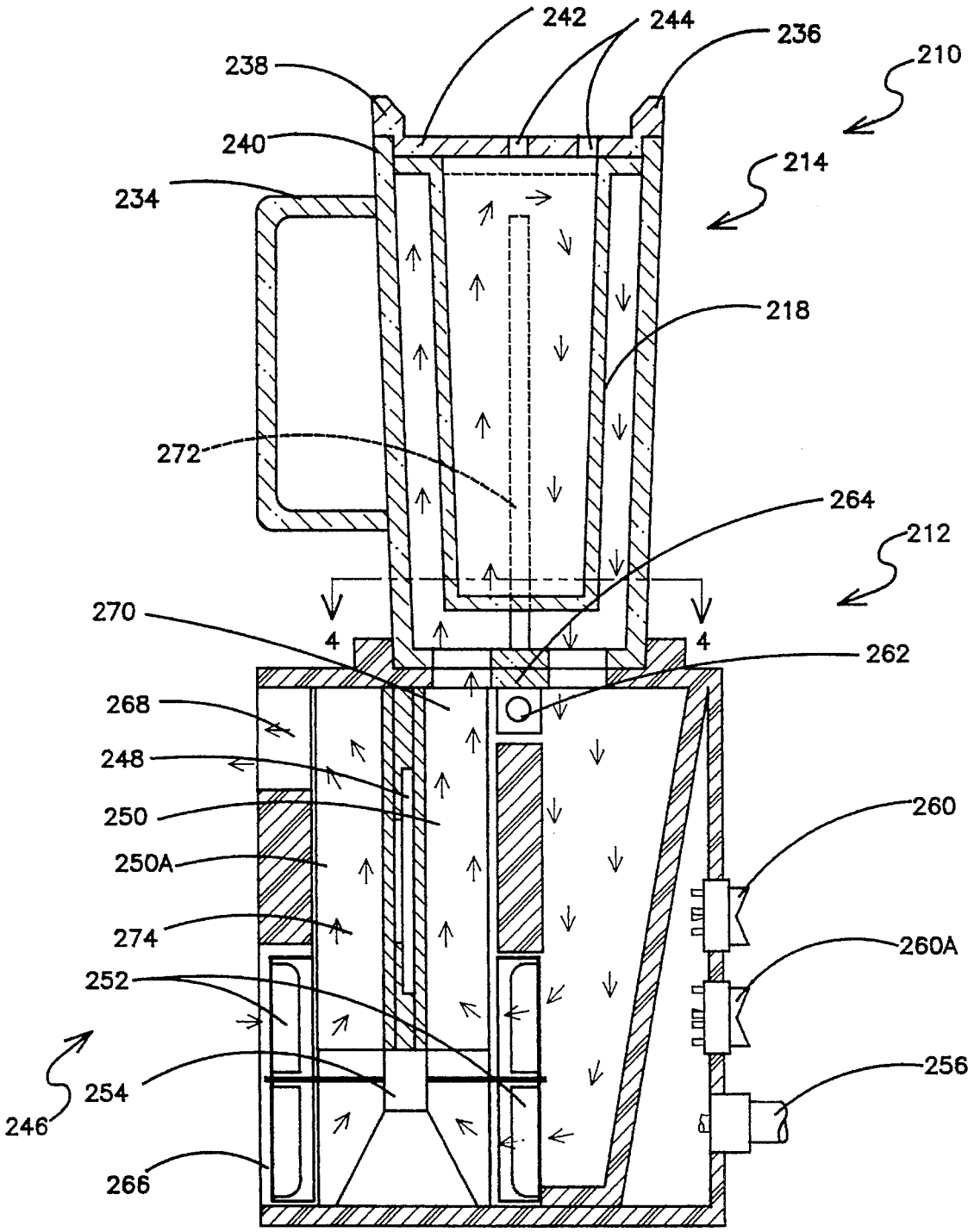
FIG. 3 is a diagrammatic, cross-sectional, side elevational view of an alternative embodiment of the invention.

As seen in FIG. 3, an alternative embodiment of portable cooler 210 functions in the manner of a mug or pitcher. A handle 234 is provided, so that cooler 210 may be lifted in one hand. Also, beverage container 218 is oriented in a normal, upright position and secured in this position. A cap 236 includes a flange 238 which cooperates with the shoulder 240 of shroud 214, or the mouth 242 of beverage container 218. Spill and vent holes 244 are provided in cap 236. Beverage may thus be dispensed from the top of cooler 210.

Again referring to FIGS. 1 and 3, portable cooler 110, 210 also includes an electrically powered refrigeration plant 146, 246 housed within base 112, 212. Refrigeration plant 146, 246 may be of any suitable type. One suitable type is a Peltier type thermoelectrical refrigeration plant, such as employed in Bohner ('611) and Kirchler ('721), including thermoelectric element 148, 248 and heat sinks 150, 150A, 250, 250A, and a ventilation circuit including fans 152, 252 and motive force element 154, 254.

Figure 5:
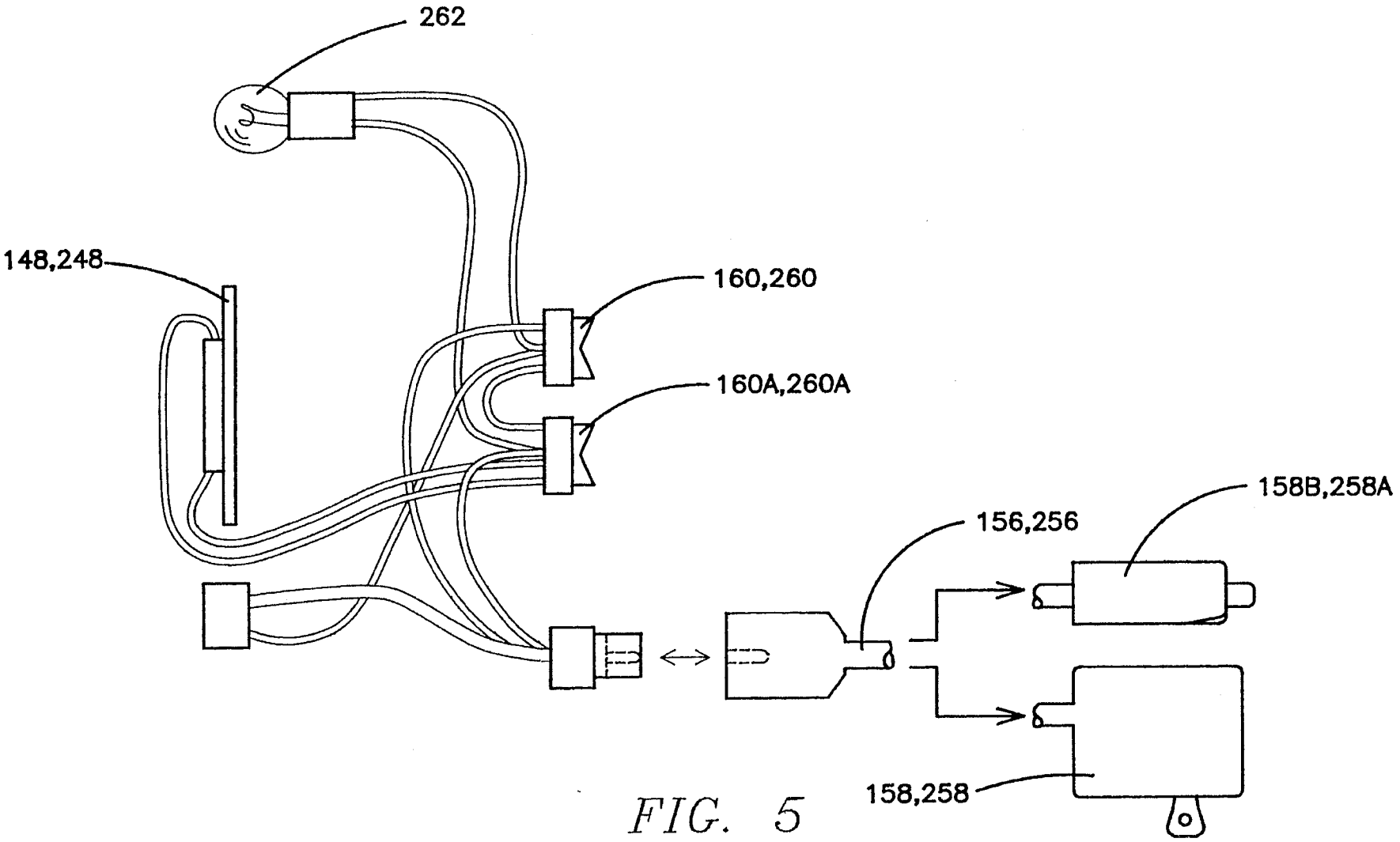
FIG. 5 is a schematic representation of an electrical circuit configuration for the inventions shown in FIGS. 1 and 3, showing an optional lamp and alternative plug configurations.

Preferably, refrigeration plant 146, 246, as shown in FIG. 5, includes an electric cord 156, 256 having a suitable plug 158,258. Plug 158,258 will be dimensioned and configured for compatibility with any suitable power source (not shown). It is contemplated that suitable power sources will include commercial AC power, such as 120 V, 60 Hz, available from a standard household electrical receptacle, and 12 V DC power. The latter is relatively conveniently available from the socket of an automotive cigarette lighter (not shown), and an appropriate plug 158A, 258A dimensioned and configured to cooperate with such a socket. A "power" switch 160, 260 is optionally provided to control refrigeration plant 146, 246. A "polarity" switch 160A, 260A is optionally provided to control direction of current flow through the thermoelectric element 148, 248.

An optional lamp 262 illuminates the shroud 214 and the beverage container 218 shown in FIG. 3. The lamp 262 and is contained within the base 212 and shines up through a transparent lens 264 in the top of the base 212, and further through the transparent structure of the shroud 214 and container 218. The lamp 262 when the "power" switch 254 is closed to indicate that the apparatus 210 is energized.

Referring again to FIGS. 1 and 3, power taken from cord 156, 256 operates both thermoelectric element 148, 248 and fan 152, 252. Fan 152, 252 provides necessary ventilation for dissipating heat generated by thermoelectric element 148, 248. A representative heat dissipation circuit is illustrated, including air inlet slots 166, 266 and air outlet slots 168, 268.

Fan 152, 252 circulates air flowing in a sealed air passage 170, 270 from the refrigeration source to beverage container 118, 218. Internal finned heat sink 150, 250, located on the cold side of thermoelectric element 148, 248, chill air flowing through air passage 170, 270.

Diametrically spaced ribs 172, 272 extending radially inward from the shroud 114,214 contact substantially the entire length of the beverage container 118, 218 along opposite sides, as shown in FIGS. 1 and 2, and FIGS. 3 and 4. These ribs 172, 272 direct air flow upward along one side of the beverage container 118, 218 and downward along the opposite side. As indicated by arrows, air contacts beverage container 118, 218 and returns to dissipate heat to internal heat sink 150, 250.

On the hot side of thermoelectric element 148, 248, external finned heat sink 150A, 250A reject heat to the ambient atmosphere through sealed air passage 174, 274.

Figure 6:
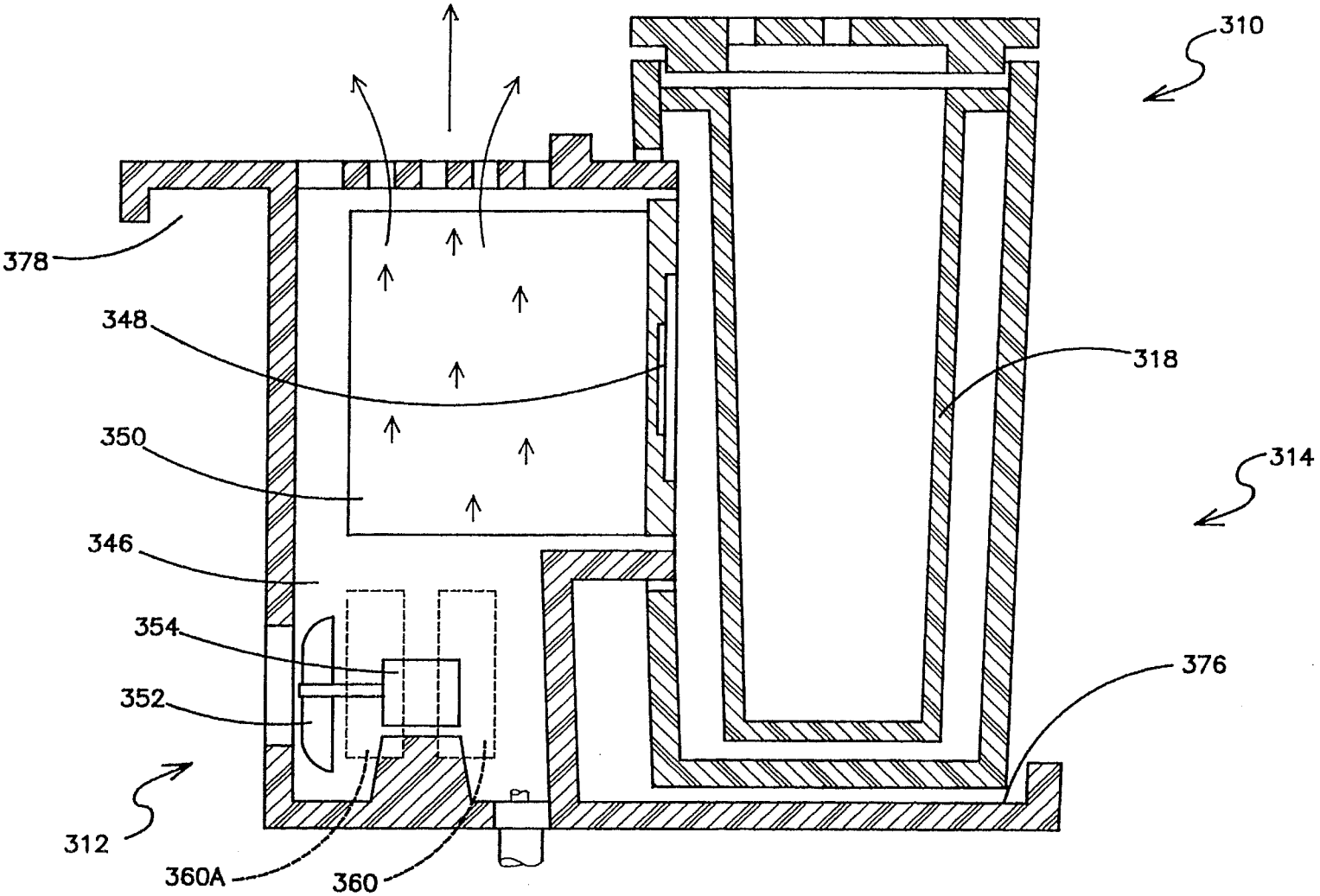
FIG. 6 is a diagrammatic, cross-sectional, side elevational view of another embodiment of the invention.

FIG. 6 shows yet another portable cooler 310. This cooler 310 likewise includes a base 312, a shroud 314, and a beverage container 318 enveloped by the shroud 314.

Base 312 houses an electrically powered refrigeration plant 346. Refrigeration plant 346 includes a thermoelectric element 348 and a heat sink 350, and a ventilation circuit including a fan 352 and motive force element 354. Switches 360, 360A energize and control the polarity of the refrigeration plant 346. Refrigeration plant 346 is operable by electrical circuitry, such as that shown in FIG. 5.

The base 312 of this cooler 310 is provided with a tray 376 for supporting the beverage container 318 and shroud 314. A bracket 378 attaches the base 312 to an independent structure, such as a automotive door (not shown).

The side of the shroud 314 has an open area for receiving the thermoelectric element 348. The thermoelectric element 348 is positioned adjacent the beverage container 318 to cool or heat the beverage container 318 and thus, the beverage therein.

It is to be understood that the present invention is not limited to the embodiments described above, but encompasses any and all embodiments within the scope of the following claims.

I claim:

1. A portable beverage container cooler for carrying and chilling a beverage container, said cooler comprising:

a base including threads;

a shroud supported by said base, said shroud fully closing the beverage container, said shroud having an open end for providing access to the beverage container, said open end further including threads cooperating with said threads of said base; and an electrically powered refrigeration plant housed within said base, further including an electrical cord having a plug, for connecting said refrigeration plant to a source of electrical power.

2. The cooler according to claim 1, further including:

means disposed within said base, defining a conduit in fluid communication with the beverage container and extending to the exterior of said body; and a faucet arranged in series within said conduit, controlling dispensation of the beverage, and including an operating handle accessible from the exterior of said base;

3. The cooler according to claim 1, said refrigeration plant comprising a Peltier effect thermoelectric device.

4. The cooler according to claim 1, wherein said refrigeration plant includes a fan circulating chilled air, and said base includes means defining an air passage conducting said chilled air from said refrigeration plant through said shroud to the beverage container.

5. The cooler according to claim 1, wherein said plug is dimensioned and configured to cooperate with a standard household electrical receptacle.

6. The cooler according to claim 1, wherein said plug is dimensioned and configured to cooperate with an automotive cigarette lighter receptacle.

7. A portable beverage container cooler for carrying and chilling a beverage container, said cooler comprising:

a base;

a shroud supported by said base, said shroud for containing a beverage container, said shroud having an open end for providing access to the beverage container; and an electrically powered refrigeration plant housed within said base, further including an electrical cord having a plug, for connecting said refrigeration plant to a source of electrical power;

said refrigeration plant includes a fan circulating chilled air, and said base includes means defining an air passage conducting said chilled air from said refrigeration plant through said shroud to the beverage container.

8. The cooler according to claim 7, further including:

means disposed within said base, defining a conduit in fluid communication with the beverage container and extending to the exterior of said body; and a faucet arranged in series within said conduit, controlling dispensation of the beverage, and including an operating handle accessible from the exterior of said base.

9. The cooler according to claim 7, wherein said refrigeration plant comprising a Peltier effect thermoelectric device.

10. The cooler according to claim 7, wherein said plug is dimensioned and configured to cooperate with a standard household electrical receptacle.

11. The cooler according to claim 7, wherein said plug is dimensioned and configured to cooperate with an automotive cigarette lighter receptacle.

12. The cooler according to claim 7, further including a lamp, said base including an upper surface, said lamp being contained within said base, adjacent said upper surface.

13. The cooler according to claim 12, wherein said shroud is transparent, said lamp being arranged in said base so as to emit light through said shroud.

14. The cooler according to claim 7, said open end further including threads, and said base further including second threads cooperating with said threads of said open end of said shroud, said shroud fully closing the beverage container.

15. The cooler according to claim 7, further including a beverage container formed integrally with said shroud, said beverage container and said shroud being joined in a spaced relation forming an insulating barrier therebetween.

16. The cooler according to claim 15, further including a handle, said handle extending from said shroud.

17. The cooler according to claim 15, further including a cap, said cap being cooperatively engageable with said open end of said shroud, said cap fully closing said shroud when engaged with said shroud.

* * * * *